US005154318A

United States Patent [19]

Lampard

[11] Patent Number: 5,154,318

[45] Date of Patent: Oct. 13, 1992

[54] INFANTS PACIFIER AND FEEDER APPARATUS

[76] Inventor: Lucille B. Lampard, 1008 Martin Behrman Walk, Metairie, La. 70005

[21] Appl. No.: 784,122

[22] Filed: Oct. 29, 1991

Related U.S. Application Data

[63] Continuation of Ser. No. 488,274, Mar. 2, 1990, abandoned.

[51] Int. Cl.[5] ..... B65D 35/56

[52] U.S. Cl. ..... 222/105; 222/183; 222/192

[58] Field of Search ..... 222/94, 95, 105, 106, 222/183, 209, 212, 214, 191, 192, 386.5; 141/18

[56] References Cited

U.S. PATENT DOCUMENTS

| | | | |
|---|---|---|---|
| 2,804,995 | 9/1957 | Fee | 222/386.5 X |
| 2,953,170 | 9/1960 | Bush | 141/18 |
| 3,104,032 | 9/1963 | Hansen | 222/91 |
| 3,383,018 | 5/1968 | Grimsley | 141/18 X |
| 4,020,978 | 5/1977 | Szczepanski | 222/209 |
| 4,047,642 | 9/1977 | Nilson | 222/94 |
| 4,098,434 | 7/1978 | Uhlig | 222/209 X |
| 4,469,250 | 9/1984 | Evezich | 222/95 X |
| 4,657,151 | 4/1987 | Cabernoch | 222/105 X |
| 4,760,937 | 8/1988 | Evezich | 222/105 X |
| 4,830,222 | 5/1989 | Read | 222/192 X |
| 4,842,165 | 6/1989 | Van Coney | 222/105 X |
| 4,888,188 | 12/1989 | Castner, Sr. et al. | 222/106 X |

*Primary Examiner*—Kevin P. Shaver

*Attorney, Agent, or Firm*—Pravel, Gambrell, Hewitt, Kimball & Krieger

[57] ABSTRACT

A food/beverage dispenser for infants and small children includes a tubular flexible outer housing and a tubular flexible chamber which contains food. The bore housing between the tubular chamber and the housing wall is a void area that is filled during use with liquid. When a child squeezes the outer housing, the liquid between the housing and the chamber is forced downwardly compressing the chamber and dispensing food/-beverage contained therein out through a dispensing outlet which can be in the form of an elongated tubular spout or in the form of a spoon having dispensing openings in the concave bowl portion of the spoon.

4 Claims, 2 Drawing Sheets

INFANTS PACIFIER AND FEEDER APPARATUS

This is a continuation of co-pending application Ser. No. 07/488,274, filed on Mar. 2, 1990, now abandoned.

BACKGROUND OF THE INVENTION

1. Field of the Invention

The present invention relates to feeders and dispensers for children, infants and the like and more particularly relates to an improved infant/child feeder/pacifier apparatus that can be used with formula, juices, beverages, frozen substances, soft food and the like wherein concentric chambers are formed by an outer flexible deformable housing and an inner flexible deformable housing wherein the child squeezes on the outer housing thereby depressing a fluid buffer held between the outer housing and the chamber, so that food/beverage contained within the innermost chamber can be dispensed through a tip portion having one or more holes.

2. General Background

Infants and small children typically feed upon a number of soft food items such as pureed food, and/or a number of beverage items including frozen beverages. Frozen liquids can become a mixture or slurry of frozen and liquid material after the child is given the food and it begins to melt.

Small children and infants often use teething rings or pacifiers to stop teething pain. Infants also are often fed through pacifier-like dispensing devices which have a cylindrical chamber and a push rod for forcing liquid from the chamber through a pacifier or nipple dispensing end portion. Such dispensing devices are known and used commercially such as are sold under the trademark "Infa-Feeder".

Some commercially available pacifiers are solid, and of a flexible material such as rubber or plastic. Other pacifiers have a liquid filled interior such as a rubber or plastic pacifier having water on its inside.

It is an object of the present invention to combine a food/beverage dispenser with a pacifier which allows the child to feed or his or herself even if the child's motor skills are not fully advanced. Thus, the present invention eliminates the need for push rods, triggers or other devices for feeding the child, because the child's normal squeezing pressure upon the apparatus produces the dispensing of the food/beverage product. Further, even if the child is unable to squeeze large amounts of food from the dispenser of the present invention, the apparatus provides a unique teething structure which acts as both a teething ring/pacifier for the infant as well as dispenser for food/beverage therefrom.

A number of pacifiers and dispensers and even combinations of the two have been patented. For example a pacifier which is designed to dispense medicine, vitamins and the like as seen in U.S. Pat. No. 2,612,165 issued to Szuderski entitled "Medicated Pacifier". The apparatus includes an outer pacifier structure having a plurality of openings in the nipple end portion of the pacifier which is normally inserted in the mouth of a child or infant. A circular ring is provided for gripping by the child. An object of the Szuderski patent is to provide a pacifier which includes a container that holds a substance for consumption by the child for example medication including vitamins, the container being a foramanous or porous and readily replaceable structure and the nipple being provided with a number of aperatures whereby the contents of the container may be drawn therefrom while the infant or child is using the pacifier.

An example of an infant's spoon is seen in U.S. Des. Pat. No. 167,623 in which the spoon has a ring type structure attached to one end portion thereof.

U.S. Pat. No. 1,913,627 provides a nursing and teething nipple and pacifier construction. U.S. Pat. No. 2,665,693 issued to Pecora provides an infant teething and feeding device.

In U.S. Pat. No. 2,889,829 issued to Tannenbaum et al. there is provided a pacifier having a reservoir for holding a quantity of a desired fluid substance.

The Demiere U.S. Pat. No. 3,865,115 provides a spoon of stainless steel with a handle and a bowl or head at one end of the handle. The other end of the handle is secured via a metal to plastic seal to a plastic teething ring.

U.S. Pat. No. 4,192,307 issued to Baer and entitled "Pacifier With Sweet Dispensing Nipple", provides a pacifier having a nipple with a small chamber, the wall of which has perforations. In use, the chamber is supplied with flavored sweets such as candy or frozen fruit juices.

Most of these prior art references relate primarily to small pacifier type structure holding minute amounts of liquid, rather than the improved food/beverage dispenser of the present invention which provides for a relatively large reservoir of food/beverage to be dispensed to the infant or child responsive to the child's squeezing of the overall housing of the device. Thus, the present invention provides an improved feeder/pacifier apparatus with a unique configuration that solves the problem of providing an infant with both a feeding/dispensing device and a pacifier.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

FIGS. 1-5 and 8 illustrate the preferred embodiment of the apparatus of the present invention designated generally by the numeral 10.

Figure 1:
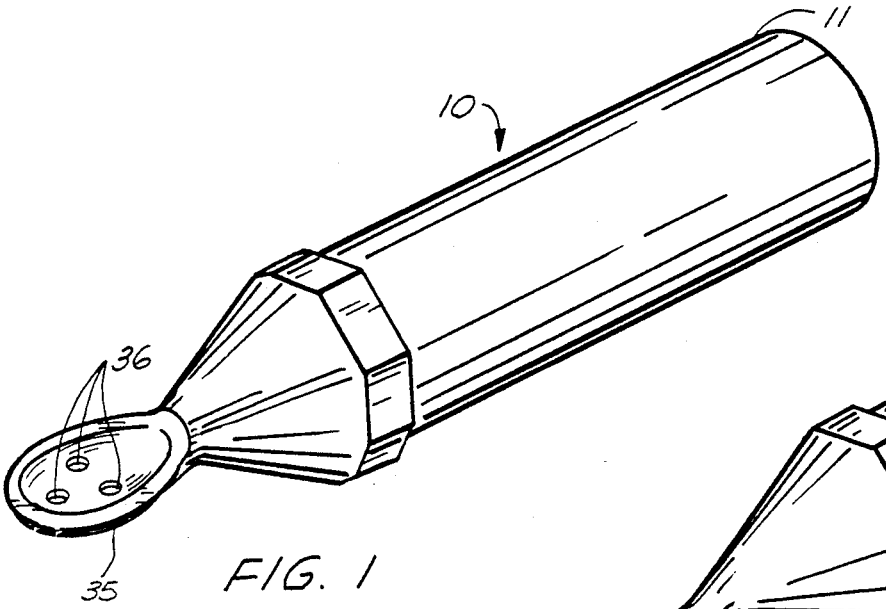
FIG. 1 is a perspective view of the preferred embodiment of the apparatus of the present invention.
Figure 3:
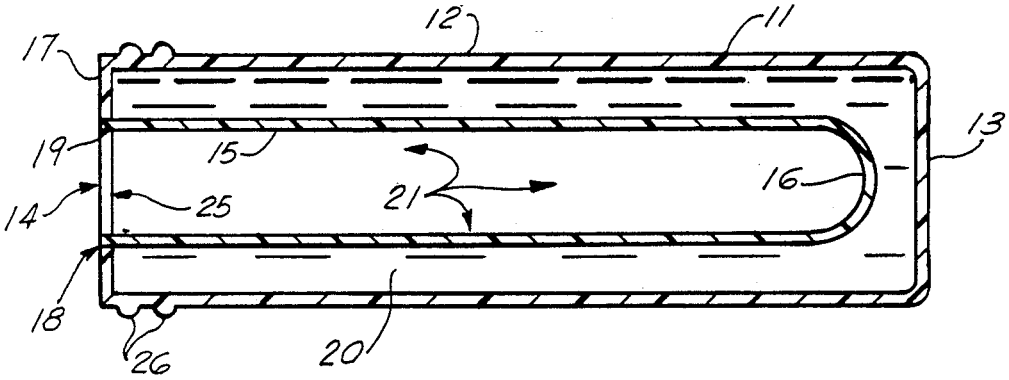
FIG. 3 is a partial sectional elevational view of the preferred embodiment of the apparatus of the present invention illustrating the housing and internally tubular chamber portions thereof.
Figure 4:
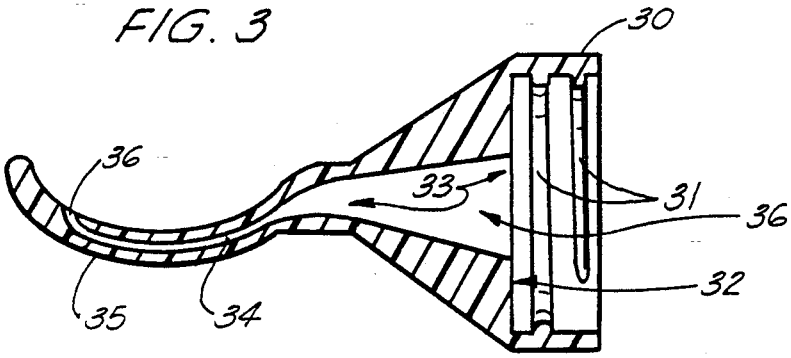
FIG. 4 is a fragmentary sectional view of the preferred embodiment of the apparatus of the present invention illustrating a sectional view of the dispensing top portion embodying a spoon end.

In FIGS. 1 and 3 there can be seen an overall housing 11 which is generally cylindrical in shape having a cylindrical outer wall 12 and a closed hemispherical end wall 13 forming a closure with cylindrical wall 12. The opposite end portion of the housing 11 from the end wall 13 provides an open dispensing portion 14 that carries a tubular flexible chamber 15 in the form of an elongated cylinder having a closed end portion 16.

The housing 11 provides a circular closure 17 having a central circular opening 18 that is of an internal diameter substantially equal to the external diameter of the tubular chamber 15 so that the external diameter of the chamber 15 at its end portion 19 forms a frictional fluid type fit with opening 18 as best seen in FIG. 3. A seal such as an 0 ring, annular flange, or the like could be provided to perfect a fluid tight seal between the end portion 19 of chamber 15 and the circular end 17 of housing 11 so that when the housing 11 is squeezed by the infant, fluid contained in the annular space 20 between chamber 15 and housing 11 will not leak but will be retained therein. This is important because as the infant squeezes upon the outer walls 12 of housing 11 as shown by the arrows 22 in FIG. 5, there is a simultaneous collapsing as shown by the arrows 23 of the chamber 15 which causes the food/beverage product contained within the chamber 15 interior 21 to be dispensed through outlet 25.

Housing 11 outer wall 12 carries a plurality of external threads 26 which registers with and forms a threaded connection with the internal threaded portion 31 of dispensing outlet 30. Outlet 30 provides a closure over the end 14 of housing 11.

The dispensing outlet member 30 includes a flat internal surface 32 which is sized to register upon the circular closure 17 of housing 11. Further note that dispensing outlet 30 includes a bore 33 which gradually narrows in diameter to a small channel 34 at spoon end portion 35. However, the bore 33 is of a cross-sectional area and diameter at its innermost end portion 36 so that it registers with the outlet 25 of chamber interior 21. Thus, the circular dimension of the portion 36 would be substantially equal to the circular cross-sectional configuration of the outlet 25.

Figure 2:
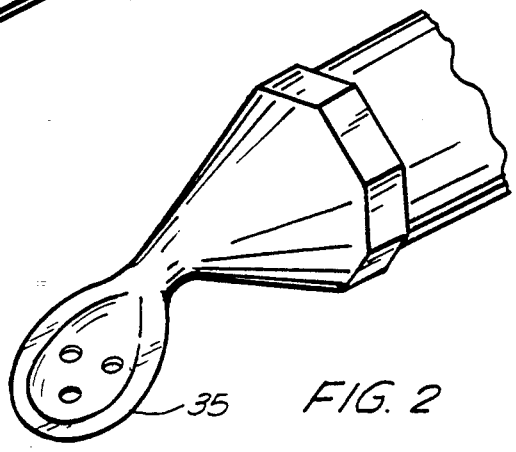
FIG. 2 is a fragmentary view of an alternate embodiment of the apparatus of the present invention showing an offset dispensing spoon portion.
Figure 5:
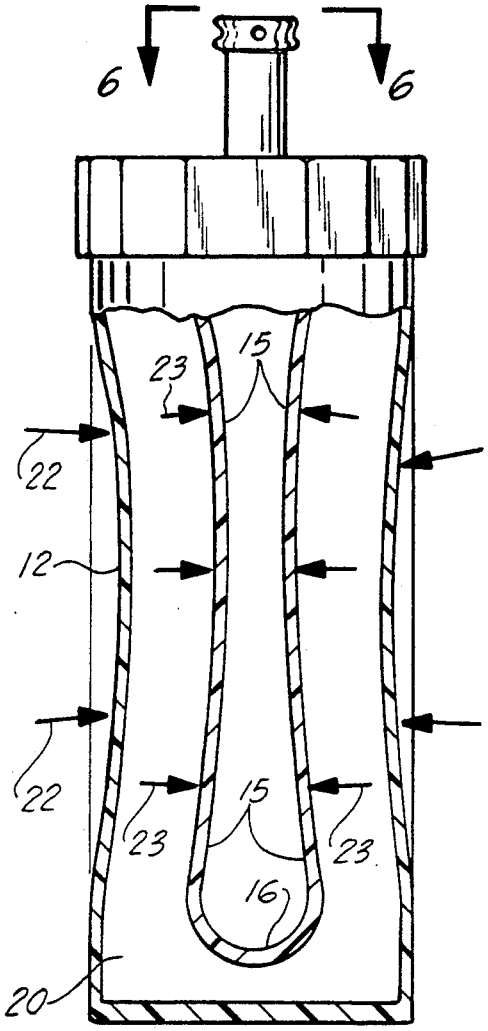
FIG. 5 is a sectional elevational view of the preferred embodiment of the apparatus of the present invention.

In the embodiment of FIG. 2, the spoon 35 is slanted laterally away from the longitudinal centerline of the cylindrical housing 11. This offset configuration provides an easier structure for the infant to place in his/her mouth when holding the housing 11. Channel 34 communicates with one or more dispensing openings 36 so that when the infant squeezes upon housing 11 as indicated in FIG. 5, fluid pressure within the space 20 causes chamber 15 to collapse dispensing fluid through outlet 25 and into bore 33 communicating with channel 34 and thus with the openings 36.

Figure 8:
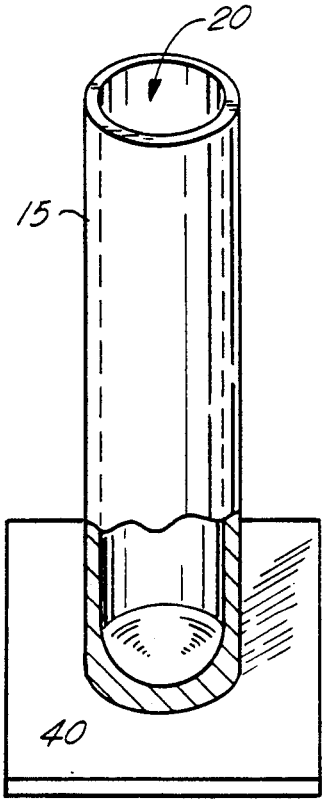
FIG. 8 is a perspective view of the preferred embodiment of the apparatus of the present invention illustrating the tubular food/beverage holding chamber portion thereof.

In FIG. 8, there can be seen a view of the chamber 15 removed from the apparatus 10 such as would be the case during filling of the chamber interior 21 with food, beverage or the like. Further, the chamber 15 could be set upon a base 40 designed to cradle the chamber 15 so that the base 40 and chamber 15 could be placed in the freezer for freezing fruit juice, or other such beverage which is typically frozen before administering to the child.

Figure 7:
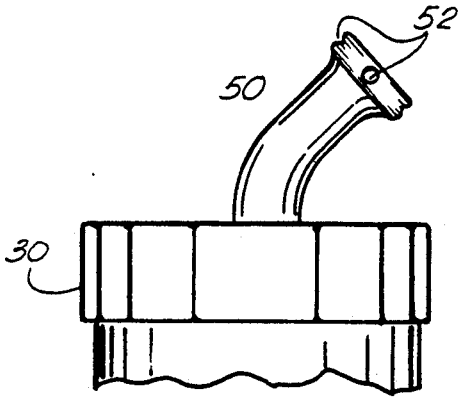
FIG. 7 is a fragmentary view of an alternate embodiment of the apparatus of the present invention illustrating a curved dispensing spout portion.
Figure 6:
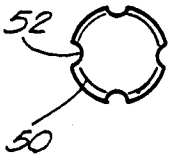
FIG. 6 is an end view of an alternate embodiment of the apparatus of the present invention illustrating the dispensing spout portion thereof.

In FIGS. 6-7, a spout 50 is carried by the dispensing outlet 30, the spout preferably being a curved conduit having an internal channel which communicates with one or more dispensing openings 52. The spout 50 and the spoon 35 would both preferably be of a soft pliable material such as a soft plastic or rubber. Similarly, the housing 12 would be of a soft pliable plastic material such as polypropylene.

The internal chamber 15 would likewise be of a soft collapsible pliable material such as polypropylene or other flexible plastic.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. A food/beverage dispenser for infants and small children comprising:

a) a tubular flexible outer hollow housing having a generally cylindrical sidewall with a first larger diameter and defining an internal housing bore;

b) a first closed end portion of the housing sealing the bore at one end of the housing, the second end of the housing defining an open end portion thereof;

c) an elongated hollow flexible cylindrically shaped tubular chamber of a second and reduced diameter along its entire length disposed longitudinally within the bore and spaced inwardly of the housing sidewall, the chamber having an interior for containing the food or beverage to be dispensed;

d) the tubular chamber having a dispensing outlet at one end portion;

e) a generally circular and transversely positioned dispensing outlet seal plate that is connectable to the dispensing end of the outer housing at the open end portion thereof, the outlet seal plate having a central opening communicating with the tubular chamber for dispensing food/beverage from the flexible tubular chamber via the dispensing opening and, wherein the opening is corresponding in size and shape to the second, reduced diameter of the tubular chamber;

f) the outer housing bore having a fluid holding portion externally of the tubular chamber that is sealed during use between the tubular chamber, the housing sidewall, and the seal plate so that squeezing pressure exerted on the external housing sidewall by an infant or child can force fluid contained in the fluid holding portion to depress the flexible tubular chamber for forcing food or beverage contained therein from the tubular chamber via the seal plate opening;

g) a flexible pacifier member removably connectable to the housing sidewall at the housing open end portion and having one or more outlets communicating with the central opening of the outlet seal plate so that the infant/child can simultaneously or selectively consume the dispensed food/beverage or teethe on the pacifier; and h) the dispensing outlet seal plate being positioned radially between the housing sidewall and the tubular chamber, forming a seal upon assembly with the housing sidewall at the periphery of the seal plate, and with the chamber at the central opening of the seal plate.

2. The dispenser apparatus of claim 1 wherein the elongated hollow flexible tubular chamber is removably attachable to the flexible outer housing.

3. The dispenser apparatus of claim 1 wherein the flexible pacifier member and dispensing outlet seal plate in combination define a closure to both the fluid holding portion of the outer housing bore and the interior of the hollow flexible tubular chamber, and sealing the fluid holding portion.

4. The dispensing apparatus of claim 1 further comprising an external gripping surface which facilitates disassembly of the flexible pacifier member and outlet seal plate from the outer housing.

* * * * *